US005439185A

United States Patent [19]

Tsukumo et al.

[11] Patent Number: 5,439,185

[45] Date of Patent: Aug. 8, 1995

[54] BOBBIN HOLDER

[75] Inventors: Zenzaburo Tsukumo; Shinsuke Tsukumo, both of Osaka, Japan

[73] Assignee: Zen Giken Co., Ltd., Osaka, Japan

[21] Appl. No.: 266,316

[22] Filed: Jun. 27, 1994

Related U.S. Application Data

[63] Continuation of Ser. No. 949,829, filed as PCT/JP92/00667, May 20, 1992, abandoned.

[30] Foreign Application Priority Data

May 21, 1991 [JP] Japan ..... 3-145353

[51] Int. Cl.[6] ..... B65H 49/02

[52] U.S. Cl. ..... 242/130.2

[58] Field of Search ..... 242/130.2

[56] References Cited

U.S. PATENT DOCUMENTS

| | | | |
|---|---|---|---|
| 3,877,659 | 4/1975 | Takata | 242/130.2 |
| 4,015,797 | 4/1977 | Tsukumo | 242/130.2 |
| 4,052,021 | 10/1977 | Tsukumo | 242/130.2 |
| 4,111,381 | 9/1978 | Kitamura | 242/130.2 |
| 4,511,102 | 4/1985 | Tsukumo et al. | 242/130.2 |

FOREIGN PATENT DOCUMENTS

| | | | |
|---|---|---|---|
| 0081585 | 6/1983 | European Pat. Off. . | |
| 51-55434 | 5/1976 | Japan . | |
| 54-29625 | 9/1979 | Japan . | |
| 54-29630 | 9/1979 | Japan . | |
| 60-148870 | 8/1985 | Japan . | |
| 8204433 | 12/1982 | WIPO | 242/130.2 |

*Primary Examiner*—Daniel P. Stodola
*Assistant Examiner*—Michael R. Mansen
*Attorney, Agent, or Firm*—Armstrong, Westerman, Hattori, McLeland & Naughton

[57] ABSTRACT

A bobbin holder wherein a roving withdrawing-tension is maintained constant by constituting a braking-torque (balanced with a bobbin-rotating-torque) working on a bobbin with a frictional force derived from the weight of a roving bobbin, with employing a sliding-contact bearing system in view of the fact that both the bobbin-rotating-torque and the load of the roving bobbin are proportional to the radius of the roving bobbin, while the braking-torque can be variably adjusted by altering the bore-diameter of a bearing and/or the coefficient of friction thereof by combining replaceable members. The basic arrangement of the bobbin holder comprises a small bore (10H) which is a bearing bore of a pivot housing (101) provided on the fixing portion side of the bobbin holder (BH), and a pivot (606) which is a pivot member for supporting the weight of a rotatable portion including the roving bobbin (Rb) in cooperation with the peripheral portion of the small bore (10H), the pivot housing (101) being composed of, for example, two bisected cylindrical halves each adapted to be replaced and combined with another one.

2 Claims, 6 Drawing Sheets

BOBBIN HOLDER

TECHNICAL FIELD

This application is a continuation of application Ser. No. 07/949,829 filed as PCT/JP92/00667, May 20, 1992, now abandoned.

The present invention relates to a bobbin holder. More particularly, it relates to a bobbin holder which is a principal functional part indispensable for roving and spinning processes in a spinning factory.

BACKGROUND ART

A conventional bobbin holder is a device in which a rolling contact bearing structure disposed axially of the bobbin holder cooperates with the bearing itself to have a rotating-resistance value of substantially 0, and a "braking mechanism" in which a brake shoe 7Bd (see FIG. 7) presses against a rotating part by means of a coiled spring 3Bp, is provided with the bearing structure. Accordingly, unless the pressing force by the coiled spring is changed, the braking-torque (b·k) on the bearing side is substantially constant, where b is produced by multiplying the pressing force by a friction coefficient $\mu$, and K is the distance from the rotation center of the rotation part to the point of action of frictional force.

Thus, in view of the fact that T·R=b·k, or the braking-torque (b·k) on the bearing side maintains a close equivalence to the rotating-torque (R·T) on the roving bobbin side, the roving withdrawing-tension T exerted on the rotating part, as roving is withdrawn, increases in inverse proportion to a decrease in the outer radius R of a roving bobbin due to withdrawing of roving. This results in the so-called "two dimensional relation" between T and R. Practically, with roving bobbins now available, the radius $R_f$ of a full bobbin is 3 to 6 times larger than the radius $R_o$ of the empty bobbin. Accordingly, even if the roving withdrawing-tension $T_f$ with a full bobbin (radius $R_f$) is set at 2.0 g., the roving withdrawing-tension $T_o$ present with an empty bobbin (radius $R_o$) actually amounts up to 6 to 12 g., which creates a problem of going far out of the optimum allowance (3.0±1 g.) according to spinning technology.

As shown in FIG. 7, in the conventional bobbin holder the space 4B in the periphery of the bearing portion is reduced by being substantially filled with the bearing structure. A fly created by dust being continually dragged into the space increases in size and finally leads to a fatal phenomenon such that it becomes tightly wound around a pivot member 3Br. Further, reciprocating shock loads produced by the doffing and donning operation of a bobbin causes steel balls 5B to hit and damage the upper and lower raceways 22R and 35R, and the impact damage progresses every time the doffing and donning operation of a bobbin is carried out. Thus, the factors accounting for a fatal defect acts synergetically, and a braking-torque is progressively increased from the value initially set, resulting in a marked and continual rise in the braking-torque (b·k) on the bearing side in an unexpectedly short period (1 to 2 years). This leads to an extreme reduction in effective life of the bobbin holder BH and to a sharp increase in problems which are fatal to both the quality of yarn and the production operation. The prior art has tried but found it difficult to solve these problems, so that it is now impossible to automatize production steps and make them continuous in order to obtain finer and higher-grade yarn.

DISCLOSURE OF THE INVENTION

There is a close negative correlation between the twist coefficient of roving being supplied and the drafting characteristic of a spinning machine. Accordingly, an important objective for improving and stabilizing the quality of spun yarn is to develop a bearing structure capable of constantly and proportionally feeding in a relaxed manner twisted roving at the very limit of allowance with an appropriate tension for a long period of time. According to reliable data obtained from a group of spindles in a scale of about ten thousand spindles, an expected value of roving withdrawing-tension T in each spindle or between spindles is restricted within the range of 3.0±1.0 g. throughout all counts of spun yarn and throughout all the kinds of spinning products. The main object of the present invention is to realize a novel bearing structure provided with a function capable of meeting the above-mentioned technical requirement and of putting it to practical use, and to establish a comprehensive and rational system related to production or assembly, adjustment, maintenance, protection, and the like.

A so-called "thrust bearing method based on sliding-contact" according to the present invention is based on the characteristic that the "rotational friction torque B·K" varies in proportion with an increase or decrease in a load P of a rotating part (hereinafter referred to as "roving bobbin weight"), which load consists mainly of the weight of a roving bobbin varying in proportion to the radius R of the roving bobbin. Further, the sliding-contact thrust bearing possesses novel features while utilizing the related arts disclosed in Japanese Patent Nos. 996924 and 995381, Japanese Patent Application No. 162304/1984, and the like, which are associated with the present invention. Thus, the method has been intensively developed as a highly innovative art. By virtue of the present invention, a way has been opened for application of a braking property inherent to the sliding-contact thrust bearing to a bobbin holder while a basic system has been accomplished for enhancing the reliability of bearing function of the bobbin holder to the highest level.

Thus, according to the present invention, there is provided a bobbin holder comprising a rotatable portion which is rotated by a bobbin-rotating-torque (T·R) varying in proportion with variation in the radius of a roving bobbin Rb as the roving is withdrawn from the roving bobbin while suspending the roving bobbin (refer to FIG. 1), a fixing portion for fixing the bobbin holder to a creel bar, or the like, and a suspending mechanism for rotatably and pivotally suspending the rotatable portion from the fixing portion. The suspending mechanism comprises a pivot member having a partially conical step portion disposed at least in either of the rotatable portion and the fixing portion, and an engaging bore disposed in the other of the two portions for engaging with the partially conical step portion to support the weight P of the rotatable portion (roving bobbin weight) so as to generate a frictional force proportional to the roving bobbin weight P in cooperation with the partially conical step portion, thereby generating a braking-torque (B·K) working on the rotatable portion and varying in proportion with an increase or decrease in the roving bobbin weight P proportional to the radius R of the roving bobbin. The resultant bobbin-rotating torque (T·R) is well-balanced with the braking-torque (B·K) such that the roving withdrawing-tension T always becomes substantially constant.

Further, the bobbin holder of the present invention is so arranged that at least a portion of a member constituting the periphery of the engaging bore is made appropriately replaceable so as to enable the bore of the engaging bore to be altered for adjusting the engagement of the pivot member therewith and/or the coefficient of friction developed by the member constituting the periphery of the engaging bore, whereby the braking-torque (B·K) can be variably adjusted.

To realize such arrangement, there has been developed, for example, a selectively combinable or adjustable apparatus utilizing a novel semi-cylindrical bearing member which is formed of bisected, molded halves so that the bore-diameter of the engaging bore of the bearing can be properly altered as far as the pivot member can be engaged therewith, while at the same time the coefficient of friction can be properly selected, whereby a bearing arrangement capable of setting the braking-torque (B·K) of the sliding-contact bearing in a discontinuous or stepped manner to a desired level is effected. With such bearing arrangement, the important objective of variably setting the tension of roving being supplied has been attained.

According to Couloms' Law wherein the braking-torque is stated as ($B \cdot K = P \cdot d/2 \cdot \mu$) in the "sliding-contact thrust bearing" of the present invention, the contact between the engaging portion and the tapered face of the pivot (1):

$$B \cdot K = P/\sin\beta \cdot d/2 \cdot \mu \quad (1)$$

Further, since the rotating torque (T·R) applied to the rotatable portion because of withdrawing of the roving from the surface of the roving bobbin Bb having radius R (refer to FIG. 1) maintains a perfect equilibrium with the braking-torque (B·K), the following equation (2) is valid:

$$T \cdot R = P/\sin\beta \cdot d/2 \cdot \mu \quad (2)$$

Hence, making the value $d/2 \cdot \mu$ constant (hereinafter referred to as "resistance coefficient K") leads to the following equation (3) with respect to the roving withdrawing-tension T:

$$T = P/\sin\beta \; R \cdot K \; P/R \cdot K \quad (3)$$

wherein $\beta$, in equations (1), (2) and (3) is the angle between the tapered face of the pivot and the longitudinal axis of the pivot.

On the other hand, since the roving bobbin weight P continues to decrease in the radius R of the roving bobbin due to withdrawing of the roving, the ratio of P to R (P/R) can be considered to be substantially constant. Accordingly, throughout the process from when the roving bobbin is full (the radius of the roving bobbin is $R_f$) to when it is empty (the radius of the roving bobbin is $R_o$), the roving withdrawing-tension T can be set specific and constant.

In addition to the above function, there has been realized means capable of easily and rationally specifying or adjusting the value K ($K = d/2 \cdot \mu$) in equation (3) for setting the roving withdrawing-tension T to a desired value by providing a bearing member having a bore-diameter d of the engaging bore of the bearing side which can be altered within the range allowing engagement with the pivot member having a predetermined diameter, and a friction coefficient $\mu$ inherent to the bearing member, for example, semi-cylindrical and molded halves having the same bore-diameter d and the same or different friction coefficient $\mu$.

As will be described with reference to FIG. 3, in the bobbin holder of the present invention, the roving withdrawing-tension T is a function of the bore-diameter d of the engaging bore on the bearing side and the friction coefficient $\mu$ of the bearing member. FIG. 3 is a schematic diagram showing an example of characteristic graph providing as an aim for setting conditions for functions of the bearing member, wherein an empirical value "braking-torque coefficient OB ($OB = \tan\theta = P/R \cdot \mu$)" is represented in a coordinate system in which bore-diameter d of the bearing member is represented in terms of X-axis while the roving withdrawing-tension T is represented in terms of Y-axis.

When a bearing bore-diameter $d_1$ is to be determined for basically setting a roving withdrawing-tension $T_{11}$ on the basis of this graph, a line $T_{11}$-$C_{11}$ is drawn parallel to the X-axis from $T_{11}$, and a point of intersection $C_{11}$ of the line $T_{11}$-$C_{11}$ with an oblique line $OB_1$ representing a friction coefficient initially selected is orthogonally projected on the X-axis to find the bearing bore-diameter $d_1$.

In turn, when a braking-torque value is to be fine-adjusted by replacing one of the two semi-cylindrical and molded halves sharing the bearing bore thus determined with another one to alter only the braking-torque coefficient inherent to the bearing member from $\tan\theta$ 1 to $\tan\theta$ 2, a line segment $d_1C_{11}$ is extended to give a line segment $d_1$-$C_{12}$ with an oblique line $OB_2$ is orthogonally projected on the Y-axis to find a point $T_{12}$ resulting from the fine adjustment. Other adjustments are achieved likewise. Thus, as a result of the present invention, a selection system has been prepared and established for arbitrary and stepwise adjustment to keep the roving withdrawing-tension T constant.

Further, in the present invention, a space of sufficient size is formed in the periphery of the bearing member, and a novel dustproof band area composed of rotatable and concentrically partitioned spaces is provided in the space for assuredly protecting the bearing function for a long period (10 years or more). Specifically, there is formed a circular annular space with the suspending mechanism assuming the axis thereof, which space comprises an upper circular annular groove formed in a top of an inner wall of the fixing portion of the bobbin holder and a lower circular annular groove formed in a top end of the rotatable portion, which grooves face vertically opposite to each other in a substantially symmetrical relation. Loosely installed in the circular annular groove in order to render the region dustproof is a cylinder substantially isolating the suspending mechanism from the outside of the bobbin holder, both upper and lower portions of which cylinder are spacedly related to the above-mentioned two grooves to define a clearance therewith. The dustproof cylinder completely encloses the suspending mechanism while concentrically partitioning the circular annular space into a plurality of spaces.

It has been verified that this structure produces an outstanding dustproof effect based on an active dust-collecting phenomenon by interwinding and thereby preventing fly from going toward the bearing portion. For example, as shown in FIG. 2, fly and dust coming into the peripheral space a gathers other fly to form matted and ball-like-shaped matter having a dust-collecting effect while the suspended rotor 2A rotates slowly, and most of the ball-like-shaped matter, due to the presence of the thin cylinder 401, remains in the chamber a with the same dust collecting phenomenon as the above also occurring in the adjacent spaces $b_1$ and $b_2$.

It should be noted that a coiled spring 402 can be mounted as a brake spring in the space to incorporate a braking mechanism for a special purpose into the arrangement of the invention (refer to FIG. 2). In this case the upper and lower parallel faces are adapted to effectively serve as friction faces.

In the bobbin holder of the present invention, there is provided connecting means allowing easy doffing and donning and being capable of remarkably improving the durability and close fitting property of the connecting portion.

Specifically, in the constitution of the connecting means of the invention, the rotatable portion of the bobbin holder comprises a suspended body for suspending the bobbin, which suspended body has a cylindrical chamber opened in a top end thereof, a substantially cylindrical block fitted into the cylindrical chamber, a circular annular recess, substantially rectangular in section, of which three sides are formed of a slope formed on the entire outer circumference of the block at the upper edge thereof and a groove 22G of V-shaped section formed on the entire inner circumference of the cylindrical chamber at a location corresponding to the slope, and a C-shaped snap ring resiliently closely fitted into the circular annular recess, whereby the weight of the rotatable portion is uniformly dispersed over the entire circumference of the C-shaped snap ring, while the three parts (the suspended rotating body, the block and the C-shaped snap ring) are integrated using the weight of the rotatable portion to make the connection secured and close.

BEST MODE FOR EFFECTING THE INVENTION

The present invention will be described in detail by way of an embodiment with reference to the drawings.

Figure 1:
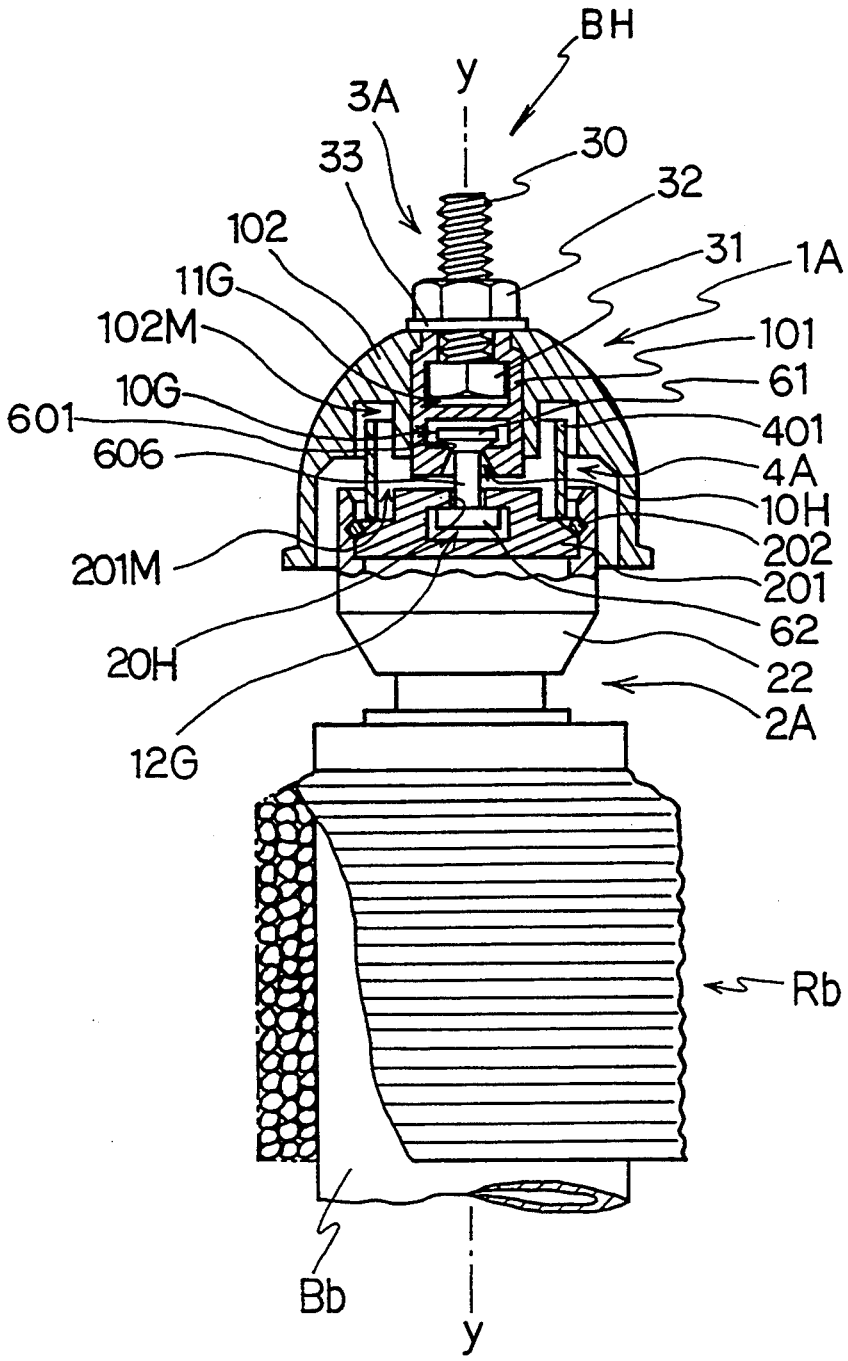
FIG. 1 is a sectional view showing an embodiment of a sliding-contact thrust bearing structure in a bobbin holder of the present invention.

In the present invention, a conventional bearing structure and its peripheral space is modified and converted into a novel thrust bearing structure for rotatably suspending a bobbin Bb based on a sliding-contact method of operation thereby radically improving functional characteristics of the bearing itself. Referring to FIG. 1, an upper structure 1A comprises an assembled construction forming a setting structure, wherein a bolt 30 and a thrust bearing (hereinafter referred to as "pivot") 606 are made separate and independent and coaxially and jointedly housed in a coupler (hereinafter referred to as "pivot housing") 101 comprising a novel bearing composed of bisected and molded halves.

In detail, the pivot housing 101 is formed by mating two bisected cylindrical and molded members obtained by splitting a cylindrical member along the axis thereof. In the body of the pivot housing 101, an upper chamber 11G and an intermediate chamber 10G are coaxially and serially formed. The upper chamber 11G accommodates a bolt head 31 fixedly, while the intermediate chamber 10G accommodates rotatably and pivotally the upper end of the pivot 606 through a small bore 10H, or the pivot head 61 shaped to have a conical or a similarly curved surface, whereby a fastening arrangement, indicated generally as 3A and the pivot 606 are coaxially jointed with each other with intervention of the pivot housing 101. The pivot housing 101 is pressed from below to fit into a top cap 102 along the axis y—y of the top cap 102, and further, the top cap 102 and the pivot housing 101 are fastened by means of a bolt 30, a washer 33 and a nut 32 to provide engagement by shoulder 103 and to integrally form the upper structure 1A. In a lower structure, on the other hand, a lower chamber 12G, which is formed in the center of a block 201 disposed on the top of a suspended rotor 2A accommodates an enlarged bottom base 62 of the pivot 606 whose shaft extends through a small opening 20H to extend upwardly and coaxially with the axis y—y. When the bobbin holder BH, thus constructed, is suspended from the creel by the setting structure, the suspended rotor 2A is completely suspended and held through the pivot 606 of which the head 61 is enclosed in the intermediate chamber 10G of the pivot housing 101, and a frictional force is generated between a circumferential contacting edge face 601 of the bearing bore having a predetermined bore-diameter d and formed in the center of the bottom of the intermediate chamber and the conical face of the pivot head 61 of the pivot 606, whereby the braking-torque ($B \cdot K = P/\sin\beta \cdot d/2 \cdot \mu$) which is inherent to sliding-contact bearing structures, is operative. The numeral 4A indicates a space in the periphery of the bearing.

Figure 2:
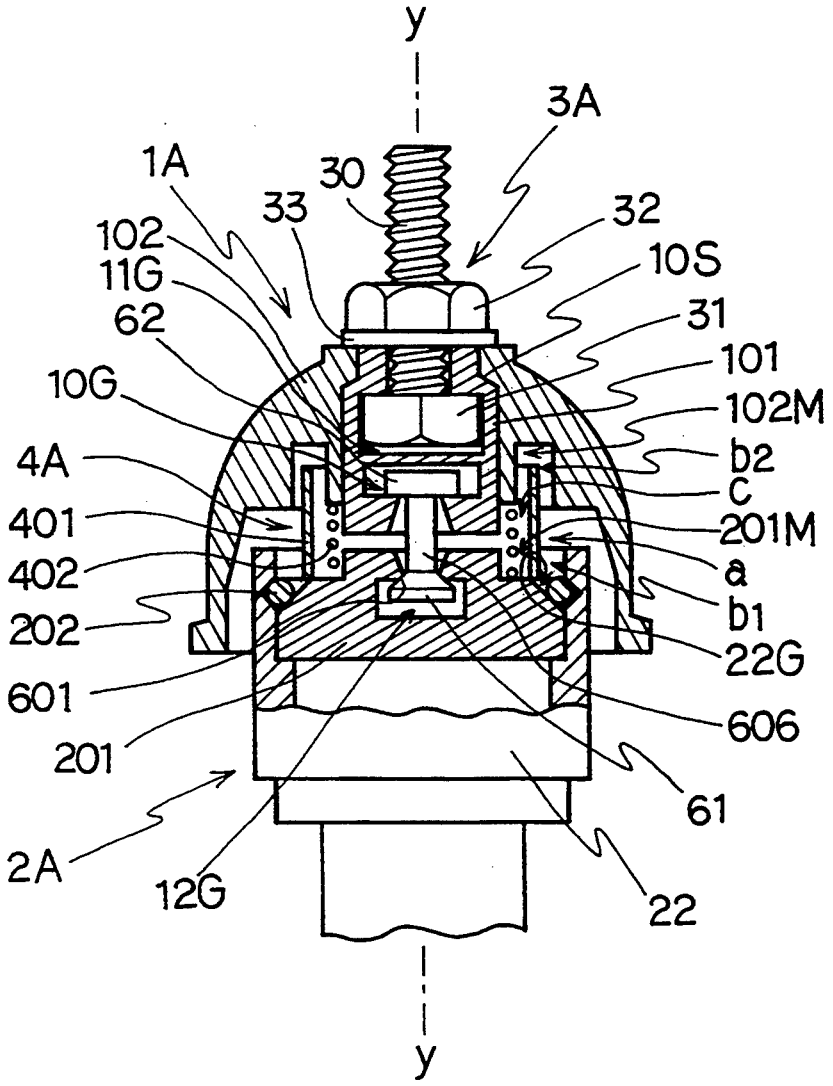
FIG. 2 is a sectional view showing another embodiment of a sliding-contact thrust bearing in a bobbin holder of the present invention, wherein a rotatable isolation band area composed of self-cleaning partitioned chambers, and the pivot shown in FIG. 1 is invertedly provided.
Figure 3:
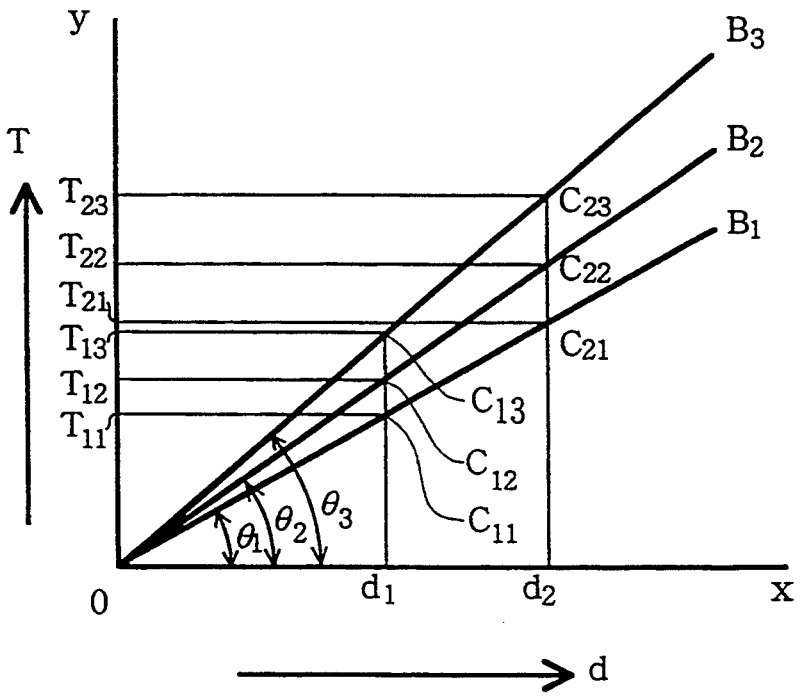
FIG. 3 is a schematic diagram showing the correlation among roving withdrawing-tension T, bearing bore-diameter d and friction coefficient $\mu$ of a bearing member, based on which are set functional conditions associated with the bearing member in the bobbin holder shown in FIG. 1.

In this case, although the block 201 containing the lower chamber 12G can be of the monolithic type or the bisected type, the latter is preferable in view of superior effectiveness and convenience in function, molding and assembling. The top end face of the lower chamber 12G can be made substantially conical for allowing pivotal movement thereat. In addition, it is also possible to form a bearing structure wherein the lower and intermediate chambers 10G and 12G shown in FIG. 1 are inverted as shown in FIG. 2. Otherwise, it has been verified that bearing structures wherein the lower chamber 12G is made similar in shape to the intermediate chamber 10G, as these members are shown in FIG. 2, the chambers 12G, 10G share the pivot 606 of which opposite ends can be made similar to each other in shape and two rotatable and slidable portions can be coaxially disposed one above the other, is optimal for use as the bearing in the bobbin holder BH. That is because both ends of the pivot 606 are similarly formed to produce reduced generated frictional forces by the interaction between the two rotatable and slidable portions when relative sliding and rotational movement occurs. Consequently, if there occurs an increase in the frictional force exerted on the sliding and rotating portion at one end, by some reason, the other end portion begins to slide and rotate in compensation for the former, thereby maintaining the braking-torque constant.

Figure 4:
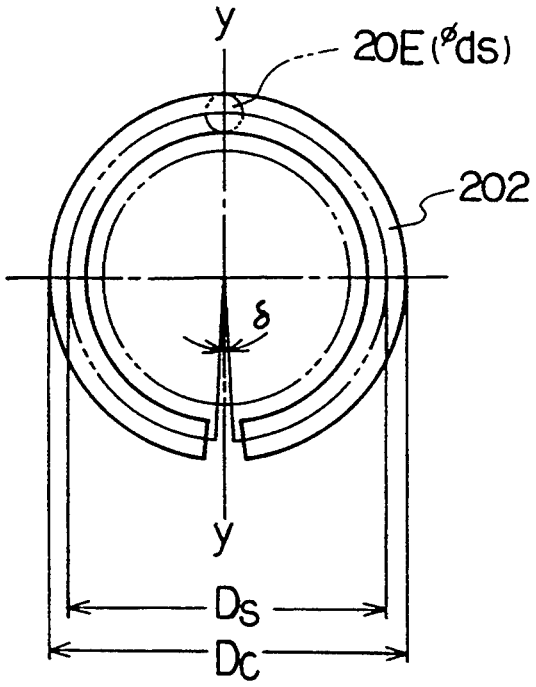
FIG. 4 is a plan view showing an original C-shaped snap ring for use in a bobbin holder of the present invention.
Figure 5:
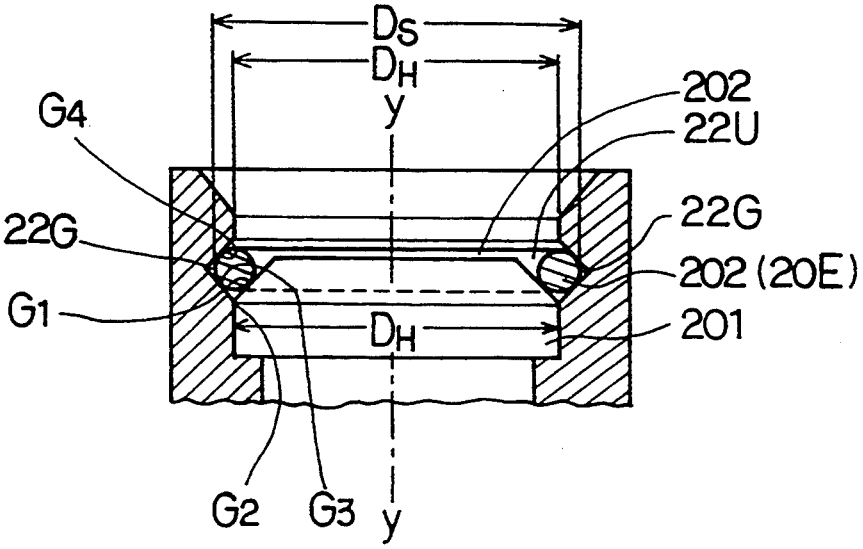
FIG. 5 is a sectional view showing an example of an integrated structure using the C-shaped snap ring shown in FIG. 4.

FIG. 5 shows an embodiment of a novel arrangement for fixedly and closely integrating a predetermined portion of a cylindrical end 22 formed in the top portion of the suspended rotor 2A (refer to FIG. 1) with the block 201 fitted into the cylindrical end 22 from above. A conical face $G_1$ formed on the shoulder of the block 201 and a V-shaped groove 22G formed in the inner wall of the end 22 so as to cross the axis y—y at right angles cooperate to share the lower edge portion $G_2$ thereof and form an annular recess 22U having a rectangular section (formed of three faces $G_1$, $G_3$ and $G_4$) of which the bottom face $G_3$ is made to have a width equivalent to the diameter $d_s$ of a wire forming a C-shaped snap ring 202 (refer to FIG. 4) to be described later. The C-shaped snap ring 202, formed of the wire having, when installed in the groove 22G, the diameter $D_s$, has a free outer diameter $D_c$ (outer diameter in unforced condition) and is fitted into the annular recess 22U along the inner wall of the cylinder while being bent so as to reduce the free outer diameter $D_c$, whereby a structure in which the end 22, the block 201 and the C-shaped snap ring 202 are closely integrated with respect to each other and can produce a well-balanced force system in terms of the vectors of the internal forces working on the three orthogonally crossed circumferential faces, including the two circumferential slopes $G_1$ and $G_4$ of the annular recess 22U and the bottom circumferential face $G_3$ according to statics principles.

The outer diameter $D_s$ of the C-shaped snap ring 202, when fitted into the annular recess 22U, is substantially the sum of the inner diameter $D_H$ of the cylinder 22 and the wire diameter of the C-shaped snap ring $D_s$ and made the same or smaller than the free diameter $D_c$, or $D_c \geqq D_s \approx D_H + d_s$.

With such structure, a close integration and secured coupling of the suspended rotor 2A, the block 201 and the C-shaped snap ring 202 can be obtained by skillfully utilizing the roving bobbin weight P.

Figure 6:
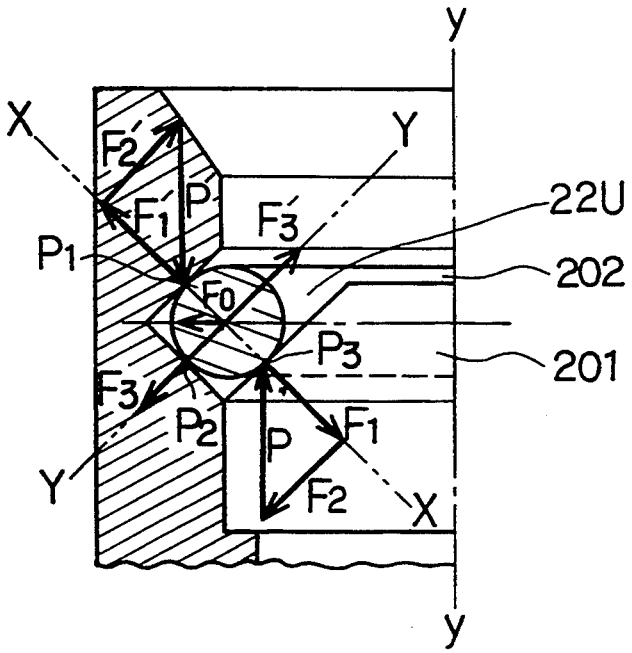
FIG. 6 is a sectional view for illustrating vector distribution of the force exerted inside the integrated structure shown in FIG. 5 by the load applied to the rotatable portion and a balanced condition of the vector distribution.
Figure 7:
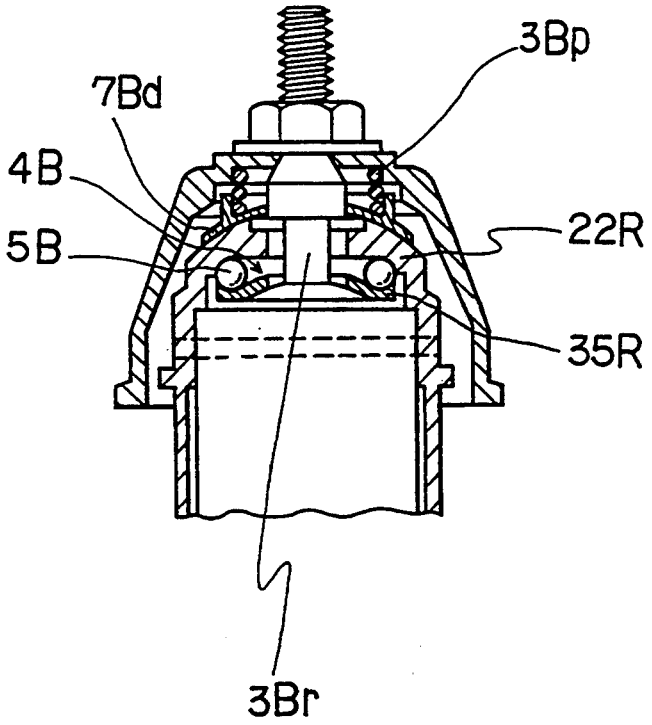
FIG. 7 PRIOR ART
FIG. 7 is a sectional view showing an example of a conventional bearing arrangement based solely on rolling contact system and provided with a braking mechanism.

FIG. 6 is a sectional view illustrating a vector distribution of the forces derived from the roving bobbin weight P and exerting on the pressure-contacted circumferential faces $G_1$, $G_3$ and $G_4$ shown in FIG. 5. Specifically, it shows a well-balanced distribution of vectors $F_1$, $F_2$, $F_3$, $F_1'$, $F_3'$ derived from the roving bobbin weight P in terms of orthogonal coordinate system X—Y passing through the three pressure-contact points $P_1$, $P_2$ and $P_3$ with the center O of the cross section 20E (refer to FIG. 4 and FIG. 5) of the wire forming the C-shaped snap ring 202 assumed as the base. Another internal force $F_o$ working on the point O which is derived from the restoring force of the C-shaped snap ring 202 causes the ring 202 to be assuredly closely fitted into the annular recess 22U and will not permit it to come out of the recess 22U even when the roving bobbin weight P of roving is not imposed.

FIG. 2 shows an embodiment of a novelly-arranged dustproof structure in the present invention which exhibits a high effect of preventing entrance of fly and dust toward the bearing. The inner top end face of the top cap 102 and the top end face of the suspended rotor 2A face opposite and parallel to each other horizontally. The two faces are formed with upper and lower circular annular grooves 102M and 201M with the axis y—y assuming a center thereof, respectively. The two circular annular grooves 102M and 201M are disposed substantially vertically symmetric so as to define a space around the bearing portion with the pivot 606 assumed as an axis. In the space, there is loosely installed a thin cylinder 401 having a predetermined height for defining a gap between a top end of the cylinder 401 and a ceiling of the upper circular annular groove 102M. Thereby, the upper and lower portions of the cylinder 401 are overlapped by the upper and lower circular annular grooves 102M and 201M, respectively, with a clearance space remaining between the top of the cylinder and the ceiling of groove 102M. The circumferential wall of the thin cylinder 401 slowly rotating in the space 4A around the pivot 606 and the un-rotating wall (inner wall of the top cap 102) facing opposite thereto produces concentrically partitioned spaces a, $b_1$, $b_2$ and c and causes the fly to interwind. The spaces cooperate to form an annular dustproof region which encloses the bearing structure and actively prevents the interwinding phenomenon of fly present in the ambient atmosphere from obstructing the bearing structure.

APPLICABILITY TO INDUSTRY

The functional innovation of the bearing portion in the bobbin holder of the present invention remarkably contributes to improvement in a bobbin holder itself. That is, it has been verified that dispersion of the roving withdrawing-tension T in a spindle or between spindles is stably confined to the range of $\pm 0.5$ g with respect to a specific standard value for a long period (semi-permanently according to practical experiments). Particularly, it is worth noting that the invention provides a safe, sure and stable feeding of extra-relaxedly twisted roving and extra-fine roving which has heretofore been considered to be practically impossible.

In pursuit of steadily matching with the progress of rationalization of equipment in spinning factories, such as larger package, higher speed, further automatization, further continuous operations, and so forth, the present invention opens the door for higher technology and is expected, at present, to highly contribute to overall technology, in other words, to improve the quality of yarn, stabilize the operations, and enhance the serviceability ratio of new equipment. More specifically speaking:

(1) it has practically been verified that the present invention enables substantial prolonging of the effective life of a bearing to a semipermanent period by a remarkably enhanced bearing capability for load, highly improved durability, increased reliability and safety to a marked level, and an excellent tenacity along with a restorability against operational shock load to a bobbin;

(2) a bobbin holder which is "maintenance free" for a long period (15 years or more) has been realized by additionally providing a novel, superior fly proof structure to avoid fatal deterioration of bearing functions;

(3) roving withdrawing-tension control in a factory can be completely intensified by rationally optimizing the roving withdrawing-tension T with ease as well as by the previous items (1) and (2);

(4) contributions to cost reduction have been made by rationalizing and simplifying the bearing arrangement thereby promoting normalization and standardization for more general purposes, as well as by enabling automatization of assembly of parts;

(5) the integrated structure by means of an originally-devised C-shaped snap ring possesses load dispersing effects based on the balance of forces and is, therefore, far superior in properties, such as load characteristic and durability, as well as convenience, safety and reliability to a conventional structure by means of pin 303, calking or the like. Therefore, it is expected, from now on, to be applied to general industrial fields, particularly to a plastic molding field broadly; and (6) the results of the present invention are not limited to the application herein described, and can be widely utilized as a precise bearing for special purpose in general industrial machines or devices (electronic devices, especially).

We claim:

1. A bobbin holder comprising:

a rotor portion for suspending a roving-containing bobbin including means for mounting a bobbin on said rotor portion for rotational movement by a bobbin-rotating torque which varies in proportion to the outer diameter of said bobbin as roving is withdrawn therefrom;

a setting structure including means for securing said bobbin holder to a suspension creel;

a suspending mechanism for rotatably and pivotably connecting said rotor portion to said setting structure including a pivot member having means at one end for suspendedly securing said pivot member to said rotor portion and means at the other end for suspendedly securing said pivot member with respect to said setting structure, at least one of said means being a conically-formed step portion operative to accommodate pivotal movement between said rotor portion and said setting structure, and an engaging bore portion provided in each of said rotatable body and said setting structure for receiving said ends of said pivot member; and means for suspendedly securing said rotor portion to said pivot member, including a substantially cylindrical wall forming an open chamber at an upper end of said rotor portion, said wall containing an annular recess formed therein;

a substantially cylindrical block received in said chamber, said block containing a sloping surface having an upper end cooperating with said recess to define a groove having three substantially rectangularly disposed sides, and a C-shaped snap ring formed of resilient wire material received in closely-fitted disposition in said groove.

2. The invention as recited in claim 1, including an axially concentric annular space defined by substantially symmetrical opposed upper and lower annular grooves formed in a top inner wall of said setting structure and a top end face of said rotor portion respectively, and a dustproofing cylinder for substantially isolating said suspending mechanism from the exterior of said bobbin holder disposed in said annular space, said dustproofing cylinder being loosely mounted with its lower end being loosely received on the bottom of said lower annular groove and having both upper and lower portions of said cylinder overlapped by surfaces of said setting structure and said rotor portion forming said respective annular grooves, whereby said cylinder encloses said suspending mechanism and partitions said annular space into concentrically spaced portions.

* * * * *